United States Patent [19]

Sorenson

[11] 4,437,569

[45] Mar. 20, 1984

[54] SHIPPING CARTON WITH CASE KNIFE PROTECTION FOR INNER CARTONS

[75] Inventor: John F. Sorenson, St. Paul, Minn.

[73] Assignee: Champion International Corporation, Stamford, Conn.

[21] Appl. No.: 424,000

[22] Filed: Sep. 27, 1982

Related U.S. Application Data

[63] Continuation-in-part of Ser. No. 398,678, Jul. 13, 1982.

[51] Int. Cl.[3] ..... B65D 65/26

[52] U.S. Cl. ..... 206/601; 206/499; 206/526; 229/37 R

[58] Field of Search ..... 206/601, 602, 603, 44 R, 206/526, 499; 30/2; 229/8, 37 R, 38, 39 R, DIG. 11, 40, 31 R

[56] References Cited

U.S. PATENT DOCUMENTS

| | | | |
|---|---|---|---|
| 2,132,958 | 10/1938 | Martin | 206/601 X |
| 2,680,557 | 6/1954 | Madden | 229/38 |
| 3,127,991 | 4/1964 | Burnett | 206/44 R |
| 3,412,924 | 11/1968 | Krzyzanowski | 206/602 |
| 3,485,435 | 12/1969 | Greene et al. | 229/40 |
| 3,693,865 | 9/1972 | Desmond et al. | 206/601 X |

FOREIGN PATENT DOCUMENTS

| | | | |
|---|---|---|---|
| 82593 | 1/1964 | France | 229/37 R |

*Primary Examiner*—William Price
*Assistant Examiner*—Gary E. Elkins
*Attorney, Agent, or Firm*—Evelyn M. Sommer; William W. Jones

[57] ABSTRACT

A shipping carton which contains other product cartons is designed so that it can be cut open with a knife without exposing the contained product cartons to damage by the knife. At least one side wall of the shipping carton is inwardly bowed so that the inner product cartons will be shifted away from the edges of the bowed side wall thereby leaving an internal void adjacent to the edges of the bowed side wall. A knife can be inserted through the edges of the bowed side wall into the void to cut the shipping carton without cutting the inner product cartons.

1 Claim, 3 Drawing Figures

SHIPPING CARTON WITH CASE KNIFE PROTECTION FOR INNER CARTONS

This is a continuation in part of my copending application Ser. No. 398,678, filed July 13, 1982.

This invention relates to an improved carton, and more particularly to an improved corrugated paperboard shipping carton in which other product-containing cartons are packaged for shipment and storage.

Most products sold at the retail level in paperboard cartons, such as cake mixes, cereals, and other similar products, are shipped in bulk and stored in larger corrugated paperboard shipping cartons. The quickest and easiest way to remove the product cartons from the shipping cartons is to cut one panel off of the shipping carton with a knife to expose the product cartons. While this procedure is quick and easy, there is a substantial risk that the knife will also cut one or more of the product cartons in the shipping carton. Such an occurrence would, of course, render the product in this cut product carton unsaleable.

The above-noted carton damage problem is a major problem which has provoked a number of solutions. In order to ensure that the inner cartons will not be touched by the case knife used to open the shipping carton, the use of spacers inside shipping cartons has been suggested, which spacers would separate the inner cartons from the shipping carton thus allowing the knife to enter the interior of the shipping carton without touching the inner cartons. This solution, however, requires that extra material, in the form of spacers be added to the package and properly positioned in the shipping carton, with additional time and money being expended. To date, the solutions offered for this problem have generally proven less than ideal since they all require extra material, or special carton forming equipment in order to be effective.

This invention relates to an improved shipping carton which can be erected with conventional carton erecting machinery, and which provides for positive displacement of the inner cartons away from portions of the shipping carton so that these portions can be cut with a knife to open the shipping carton without damaging the inner cartons. The carton is of the type having opposed pairs of major and minor side walls and pairs of major and minor end closure flaps foldably connected to opposite end edges of the major and minor side walls respectively. The carton of this invention is formed with at least one bowed side wall with the central portion of that side wall being bowed inwardly. The inward bowing of the side wall causes the product cartons in the shipping carton to be offset from the side edges of the bowed side wall which are connected to the adjacent side walls. This leaves a free space or void in the shipping carton at the fold connections between the bowed side wall and the adjacent side walls into which space a knife blade can be inserted without touching the product cartons contained in the shipping carton. Preferably each one of a pair of opposite side walls are thus bowed inwardly. To accentuate the bowing, a medial fold line is formed in the bowed side wall extending from one end to the other thereof. To open the shipping carton, a cut is made at the edge of one of the bowed panels all the way around the carton so that one of the non-bowed panels is actually cut off of the carton.

It is, therefore, an object of this invention to provide an improved corrugated paperboard shipping carton which can be cut open with minimum chance of accidentally cutting product cartons which are contained in the shipping carton.

It is a further object of this invention to provide a shipping carton of the character described wherein one or more of the side walls of the carton are medially inwardly bowed to offset the internal product cartons from the edges of the bowed side wall or walls.

These and other objects and advantages of this invention will become more readily apparent from the following detailed description of a preferred embodiment of a shipping carton formed in accordance therewith, when taken in conjunction with the accompanying drawings, in which.

Figure 1:
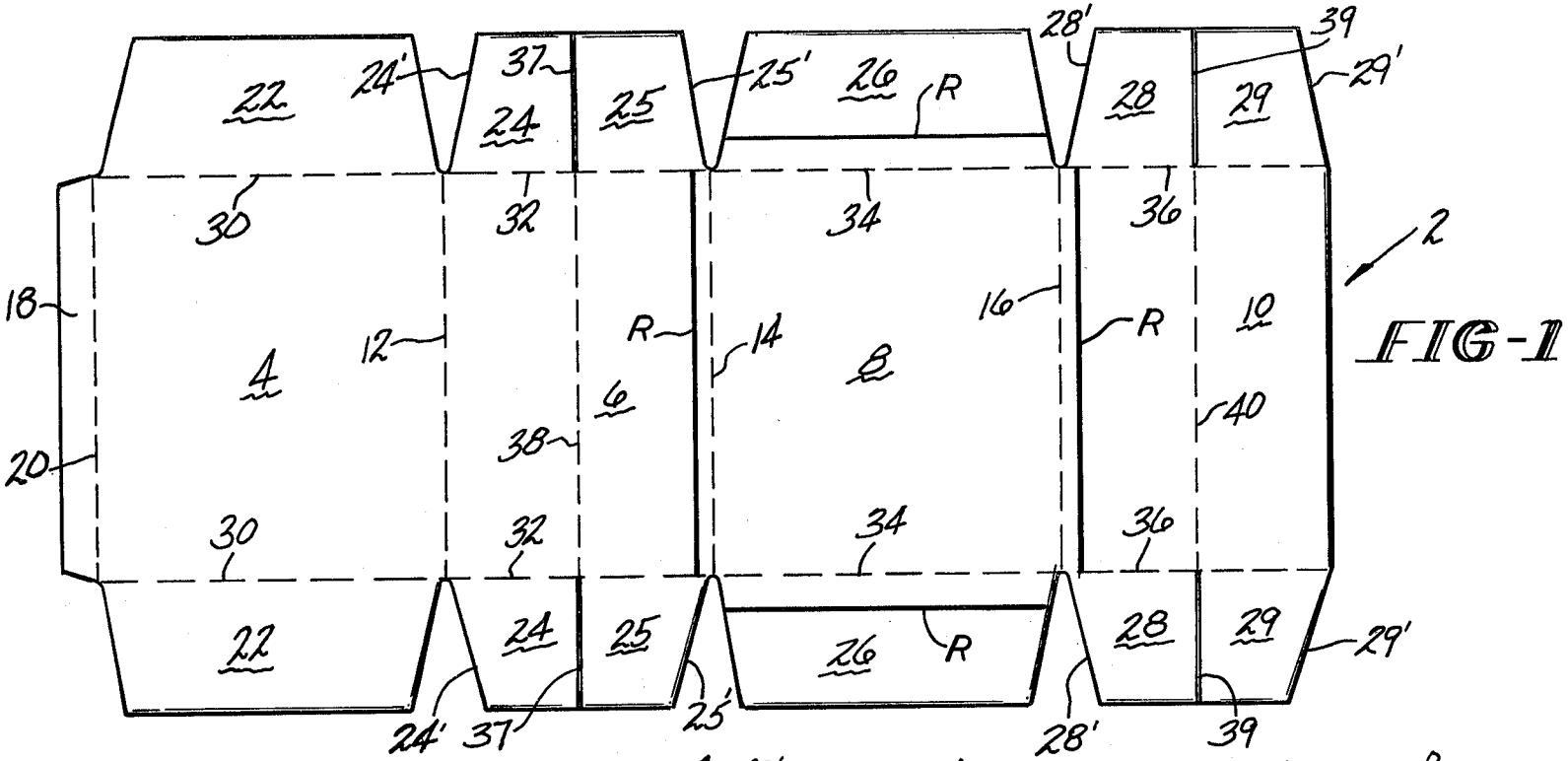
FIG. 1 is a plan view of a cut and scored corrugated paperboard blank from which a preferred embodiment of a shipping carton formed in accordance with this invention is formed.

Referring now to the drawings, there is shown in FIG. 1 a preferred embodiment of a cut and scored corrugated paperboard blank, denoted generally by the numeral 2, from which a preferred embodiment of a shipping carton formed in accordance with this invention can be erected. The blank 2 includes a plurality of side wall panels 4, 6, 8 and 10 connected together in series by parallel fold lines 12, 14 and 16. A glue flap 18 is connected to the side wall panel 4 by a fold line 20. End closure flaps 22, 24, 25, 26, 28 and 29 are connected to the side wall panels 4, 6, 8 and 10 respectively by fold lines 30, 32, 34 and 36. Each side panel 6 and 10 is provided with a medial fold line 38 and 40 respectively which extend across the side wall panels 6 and 10 between the mid points of the fold lines 32 and 36 respectively. Reference lines R are printed on the side wall panels 6 and 10 and on the end closure flaps 26 closely adjacent to the fold lines 14, 16 and 34.

The inner edges of the end closure flaps 24, 25, and 28, 29 are formed by common cut lines 37 and 39 respectively which extend from opposite ends of the medial fold lines 38 and 40 respectively. The outer side edges 24', 25' and 28', 29' of the end closure flaps 24, 25 and 28, 29 respectively converge toward each other in the direction away from the fold lines 32 and 36 respectively.

Figure 2:
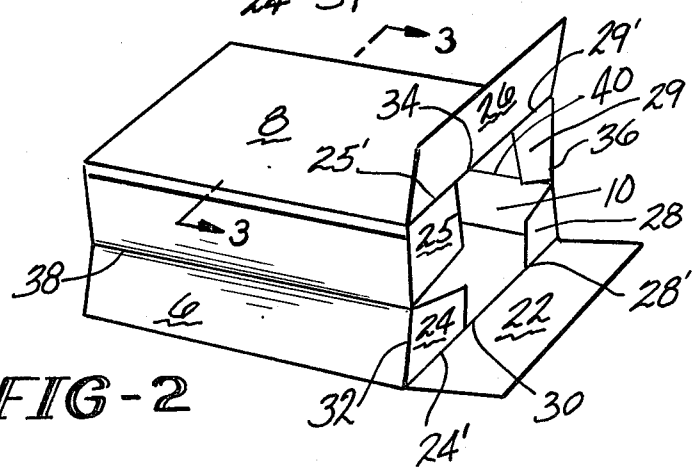
FIG. 2 is a perspective view of the erected carton formed from the blank of FIG. 1 with one set of the end closure flaps thereof being shown partially open.

Referring now to FIG. 2, the erected shipping carton formed from the blank 2 is shown. The side wall panels are folded about their respective fold lines and the glue flap is glued in place to form the generally tubular carton as shown in FIG. 2. The end closures are formed by first folding the end closure flaps 24, 25 and 28, 29 inwardly about the fold lines 32 and 36 respectively to the position shown in FIG. 2 while at the same time bowing the side wall panels 6 and 10 inwardly along the medial fold lines 38 and 40 respectively. This inward bowing of the side wall panels 6 and 10 is caused by applying a positive pressure to the side wall panels directed inwardly along the medial fold lines 38 and 40. When the panels 6 and 10 are thus bowed inwardly, the end closure flaps 24, 25, 28 and 29 will deflect so that the side edges 24' and 28' of the flaps 24 and 28 will lie closely adjacent to the fold line 30 and the side edges 25' and 29' of the flaps 25 and 29 will lie closely adjacent to the fold line 34. When the side wall panels 6 and 10 are thus bowed inwardly and the flaps 24, 25 and 28, 29 are folded inwardly about their respective fold lines 32 and 36, the adjacent edges of the flaps 24, 25 and 28, 29 formed by the cut lines 37 and 39 will diverge away from each other as shown in FIG. 2. The outer closure flaps 22 and 26 are then folded down along the fold lines 30 and 34 respectively and glued to the inner closure flaps 24, 25 and 28, 29 to hold the latter in their divergent positions. Thus, the side wall panels 6 and 10 will be held in their inwardly bowed positions.

Figure 3:
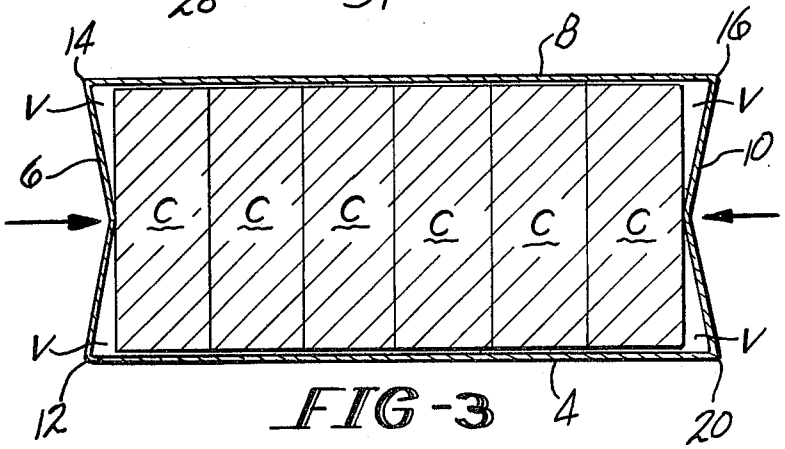
FIG. 3 is a sectional view taken along line 3—3 of FIG. 2 showing the inward medial bowing of the side walls of the carton and how this spaces the contained cartons from the side edges of the bowed side walls.

Referring now to FIG. 3, the manner in which the inner product-containing cartons C are kept away from the folded corners 12, 14, 16 and 20 by the bowed side walls 6 and 10 is shown. It is noted that inwardly of each of the corners 12, 14, 16 and 20 there is formed a free space or void V inside the shipping carton. Thus a knife used to cut open the shipping carton along any of the corners 12, 14, 16 or 20 will not touch any of the inner cartons C. The reference lines R which are shown in FIG. 1 are printed in registry with the void V and thus provide an indication as to where the carton is to be cut.

It will be readily appreciated that the shipping carton of this invention is of simple construction and yet reliably provides for internal clearance for a knife blade used to cut the carton open, whereby damage to the cartons contained in the shipping carton is avoided.

Since many changes and variations of the disclosed embodiments of the invention may be made without departing from the inventive concept, it is not intended to limit the invention otherwise than as required by the appended claims.

What is claimed is:

1. A package comprising in combination:

(a) a corrugated paperboard shipping carton comprising:

(i) a plurality of side walls interconnected at corner fold lines to form a tubular container;

(ii) a pair of inner end closure flaps foldably connected to each end of a first opposed pair of said side walls along first fold lines;

(iii) a medial fold line extending across each one of said first opposed pair of said side walls, said medial fold lines being parallel to said corner fold lines and extending between said first fold lines;

(iv) outer end closure flaps foldably connected to each end of a second opposed pair of said side walls along second fold lines;

(v) said inner end closure flaps being folded to a carton closing position wherein ones of each pair of said inner end closure flaps diverge away from each other to cause inward bowing of each one of said first opposed pair of said side walls along said medial fold lines; and (vi) said outer end closure flaps being folded to a carton closing position overlying said inner end closure flaps, and means for securing said outer end closure flaps to said inner end closure flaps to close said carton and to hold said inner end closure flaps in said diverging positions whereby the inward bowing of said first opposed pair of side walls is retained; and (b) a plurality of rectangular containers disposed in said shipping carton, said containers being arranged serially in face-to-face contact with each other within said shipping carton with endmost ones of said containers being engaged by the inner surfaces of said medial fold lines, said containers further having end walls engaging the inner surfaces of said second opposed pair of side walls on said shipping carton, and there being interior voids within said shipping carton adjacent each of said corner fold lines of said shipping carton which voids are created and maintained by reason of said medial fold lines retaining said endmost containers spaced apart from said corner fold lines, said voids being sized so as to allow knife blade cutting of said shipping carton adjacent said corner fold lines without damaging said containers.

* * * * *